US008587566B2

(12) United States Patent
Ono et al.

(10) Patent No.: US 8,587,566 B2
(45) Date of Patent: Nov. 19, 2013

(54) DRIVER FOR DISPLAY PANEL AND IMAGE DISPLAY APPARATUS

(75) Inventors: Shinya Ono, Yokohama (JP); Yoshinao Kobayashi, Kanagawa (JP); Kohichi Miwa, Yokohama (JP)

(73) Assignees: Kyocera Corporation, Kyoto-Shi (JP); Chi Mei Optoelectronics Corp., Tainen County (TW); Chimei Innolux Corporation, Miao-Li County (TW)

( * ) Notice: Subject to any disclaimer, the term of this patent is extended or adjusted under 35 U.S.C. 154(b) by 1394 days.

(21) Appl. No.: 11/159,317

(22) Filed: Jun. 23, 2005

(65) Prior Publication Data

US 2006/0001621 A1 Jan. 5, 2006

(30) Foreign Application Priority Data

Jun. 25, 2004 (JP) ..... 2004-188835

(51) Int. Cl.
*G09G 3/00* (2006.01)

(52) U.S. Cl.
USPC ..... 345/204; 345/87; 345/100; 315/169.1; 349/149

(58) Field of Classification Search
USPC ..... 315/169.1–169.4; 345/82, 204; 349/149
See application file for complete search history.

(56) References Cited

U.S. PATENT DOCUMENTS 5,859,627 A * 1/1999 Hoshiya et al. ..... 345/100
5,973,456 A * 10/1999 Osada et al. ..... 315/169.1
5,982,470 A * 11/1999 Nakahara et al. ..... 349/153
6,031,258 A * 2/2000 Ranjan et al. ..... 257/203
6,191,479 B1 * 2/2001 Herrell et al. ..... 257/724
6,194,960 B1 2/2001 Nagumo
6,693,384 B1 * 2/2004 Vicentini et al. ..... 315/169.1
6,697,037 B1 * 2/2004 Alt et al. ..... 345/93
6,750,926 B2 * 6/2004 Ohgiichi et al. ..... 349/40
6,858,992 B2 * 2/2005 Park et al. ..... 315/169.3
7,055,069 B2 * 5/2006 Isom et al. ..... 714/43
7,129,918 B2 * 10/2006 Kimura ..... 345/82
7,183,582 B2 * 2/2007 Imamura ..... 257/88
7,209,207 B2 * 4/2007 Ting ..... 349/149
7,224,424 B2 * 5/2007 Hwang et al. ..... 349/152
7,636,146 B2 12/2009 Fujita

FOREIGN PATENT DOCUMENTS

JP 62-227195 A 10/1987
JP 04-322299 A 11/1992
JP 10-333641 A 12/1998
JP 2000-103111 A 4/2000
JP 2001-056477 2/2001
JP 2003-216064 7/2003
JP 2003-347693 A 12/2003
JP 2004-61631 A 2/2004
JP 2004-144928 A 5/2004
JP 2004-177796 6/2004
JP 2005-092185 A 4/2005

* cited by examiner

*Primary Examiner* — Grant Sitta
(74) *Attorney, Agent, or Firm* — Birch Stewart Kolasch & Birch, LLP

(57) ABSTRACT

A driver for driving a display panel having a light emitting element includes a plurality of control pads, each of which is electrically connected to a control line of the display panel; and a plurality of power source pads, each of which is electrically connected to a power source line of the display panel and is larger in area than the control pad. The control pads and the power source pads are arranged in line and an order of arrangement of the control pads and the power source pads is symmetrical with respect to a direction of pad arrangement.

15 Claims, 8 Drawing Sheets

DRIVER FOR DISPLAY PANEL AND IMAGE DISPLAY APPARATUS

BACKGROUND OF THE INVENTION

1. Field of the Invention

The present invention relates to a driver for a display panel and an image display apparatus that employ an organic light-emitting diode (OLED), and more particularly to a driver for a display panel and an image display apparatus that can prevent generation of uneven luminance and allow space saving.

2. Description of the Related Art

Along with the growing popularity of mobile computing, demand for flat-type displays is increasing. Commonly used flat-type display is a liquid crystal display, which however is not immune to problems such as a narrow viewing angle and unfavorable response characteristics.

In recent years, image displays employing OLEDs have attracted attentions as flat-type image displays with a wide viewing angle and good response characteristics. The OLED recombines positive holes and electrons injected into a light emitting layer to emit light.

Such conventional image display apparatus includes, for example, a plurality of pixel circuits arranged in a matrix, a signal line driving circuit that supplies a luminance signal described later via plural signal lines to the plurality of pixel circuits, and a scan line driving circuit that supplies a scanning signal to the pixel circuits for selection of a pixel circuit to which the luminance signal is to be supplied via plural scan lines.

FIG. 8 is a block diagram of a structure of a conventional image display apparatus. The image display apparatus shown in FIG. 8 includes an organic electroluminescent (EL) panel 1, a controller 2, a gate driver 3, a drain driver 4, and a common driver 5. A pixel circuit in the organic EL panel 1 is, as shown by an equivalent circuit diagram in FIG. 8, formed with an OLED 6, a driving transistor 7, a selecting transistor 8, and a capacitor Cp, and the pixel circuits are arranged like a matrix.

The OLED 6 is a light emitting device that emits light when a voltage equal to or higher than a level of a threshold is applied between an anode and a cathode. With the application of the voltage equal to or higher than the threshold between the anode and the cathode of the OLED 6, electric currents flow through an organic EL layer to make the OLED 6 emit light. The anode of the OLED 6 is connected to a common line CL provided for each row (i.e., horizontal direction in the drawing) of the organic EL panel 1.

The driving transistor 7 is formed from an n-channel thin film transistor (TFT). A gate of the driving transistor 7 is connected to a source of the selecting transistor 8. Further, a drain of the driving transistor 7 is connected to the cathode electrode of the OLED 6. Further, a source of the driving transistor 7 is connected to the ground (0V).

The driving transistor 7 serves to switch over an ON state and an OFF state of the power supplied to the OLED 6. The gate of the driving transistor 7 retains a driving signal supplied from the drain driver 4 described later.

The driving transistor 7 has characteristics that an on-resistance attains a sufficiently lower level than resistance of the OLED 6 (e.g., not more than one tenth), and an off resistance attains a sufficiently higher level than the resistance of the OLED 6 (e.g., not less than ten times) when a common signal is applied to the OLED 6 by the common driver 5 described later. Hence, when the driving transistor 7 is ON, most of the voltage output from the common driver 5 is divided and supplied to the OLED 6, whereby the OLED 6 emits light with substantially the same intensity regardless of the fluctuation in characteristics of the driving transistors 7.

On the other hand, when the driving transistor 7 is OFF, most of the voltage output from the common driver 5 is divided and supplied between the source and the drain of the driving transistor 7, and the OLED 6 does not receive a voltage of a level equal to or higher than the threshold, whereby the OLED 6 does not emit light.

The selecting transistor 8 is formed from an n-channel TFT. The gate of the selecting transistor 8 is connected to a gate line GL provided for each row (arranged along the horizontal direction in the drawing) in the organic EL panel 1, whereas the drain of the selecting transistor 8 is connected to a drain line DL provided for each column (arranged along the vertical direction in the drawing) in the organic EL panel 1. Further, the source of the selecting transistor 8 is connected to the gate of the driving transistor 7. The selecting transistor 8 serves to switch over between an ON state and an OFF state of the supply of the driving signal to the gate of the driving transistor 7 from the drain driver 4 described later.

The capacitor Cp retains the driving signal supplied from the drain driver 4 described later for at least one sub field time period. The driving signal retained by the capacitor Cp is used for switching over of the driving transistor 7 between ON and OFF. The capacitor Cp and the driving transistor 7 together form a switch to cause the OLED 6 to emit light.

The gate driver 3 outputs selection signals $X_1$ to $X_n$ according to a gate control signal GCONT supplied from the controller 2. Only one of the selection signals $X_1$ to $X_n$ is rendered active at one timing to select a gate line GL in the organic EL panel 1. Thus, the selection signal is supplied to the gate of the selecting transistor 8 connected to the selected gate line GL, whereby the selecting transistor 8 is turned ON.

The drain driver 4 includes a shift register, a latch circuit, and a level converter. In the shift register, one (i.e., a logic "high") is set as an initial bit in response to a start signal contained in a drain control signal DCONT supplied from the controller 2, and the bit shift occurs at every receipt of a shift signal in the drain control signal DCONT.

The latch circuit is formed from plural latch circuits of the number corresponding to the number of the bits of the shift register. A latch circuit, which corresponds to the bit to which "one" is set in the shift register, latches a light emission signal IMG supplied from the controller 2. When the light emission signals IMG for one row in one subfield are latched in the latch circuit, in response to a switching signal in the drain control signal DCONT, the latched light emission signals IMG are shifted and latched by the latch circuit in the next stage. Then, the latch circuit continues to latch the light emission signals IMG for the next row.

The level converter outputs driving signals $Y_1$ to $Y_n$ of a predetermined voltage corresponding to the light emission signals IMG latched by the latch circuit to the drain lines DL of the organic EL panel 1 according to an output enable signal in the drain control signal DCONT. Each of the driving signals $Y_1$ to $Y_n$ supplied from the level converter is accumulated on the gate of the driving transistor 7 and turns the driving transistor 7 ON.

The common driver 5 generates common signals $Z_1$ to $Z_n$ to be applied to the anode electrodes of the OLED 6 based on a common control signal CCONT supplied from the controller 2. Each of the common signals $Z_1$ to $Z_n$ takes one of two values, i.e., ON or OFF, and is applied to the anode electrodes of the OLED 6 of each row via the common line CL. Thus applied ON voltage is sufficiently higher than the level of the threshold voltage of the OLED 6.

Here, the common signals $Z_1$ to $Z_n$ are power source voltages supplied to the OLED 6 and have a higher level than the voltage levels of the selection signals $X_1$ to $X_n$ and the driving signals $Y_1$ to $Y_n$. Hence, if the lines are to be identified according to the voltage levels thereof, the common line CL can be labeled as a power source line, whereas the gate line GL and the drain line DL are labeled as control lines.

When the driving transistor 7 is ON, a voltage of a level to cause saturation of the emission luminance of the OLED 6 is applied between the anode electrode and the cathode electrode of the OLED 6. On the other hand, when the driving transistor 7 is OFF, the voltage to be applied between the anode electrode and the cathode electrode of the OLED 6 attains a lower level than the threshold voltage of the OLED 6 since most of the voltages of the common signals $Z_1$ to $Z_n$ are divided and supplied to the driving transistors 7.

Here, plural pads (corresponding to terminals) are provided for the gate lines GL, the drain lines DL, and the common lines CL in the gate driver 3, the drain driver 4, and the common driver 5, respectively. Each pad is electrically connected to the corresponding gate line GL, drain line DL, or common line CL.

Further, an amount of electric current flowing through the common line CL which serves as the power source line is larger than the amount of electric current flowing through the gate line GL or the drain line DL that serve as the control lines. Hence, the pad for the common driver 5 (i.e., the pad connected to the power source line) needs to be larger in area than the pad for the gate driver 3 or the drain driver 4 (i.e., the pad connected to the control line) to ease the influence of the large electric current.

Such conventional device is disclosed in Japanese Patent Application Laid-Open No. 10-333641.

In the conventional image display apparatus, however, together with the increase in the size of the organic EL panel 1, the wirings such as the common line CL, the gate line GL, and the drain line DL become longer to increase the wiring resistance. In particular, since the voltage level of the common signals $Z_1$ to $Z_n$ is relatively high compared with signals supplied via the gate line GL and the drain line DL, the voltage drop in the common line CL which serves as the power source line is more significant than in other lines. Hence, in the conventional image display apparatus, voltages supplied to the OLED 6 (i.e., the voltage levels of the common signals) varies significantly according to the difference in the length of the common lines CL from the common driver 5 (i.e., the difference in the amount of voltage drop), thereby causing the unevenness in luminance.

If the OLED 6 is located in the vicinity of the common driver 5, the common line CL extending from the common driver 5 to the OLED 6 is short in length. Then, the voltage drop along the common line CL is small and a predetermined voltage can be supplied to the OLED 6, resulting in the emission of light with a predetermined luminance. On the other hand, if the OLED 6 is far from the common driver 5, the common line CL extending from the common driver 5 to the OLED 6 is long in length. Then, the voltage drop is large and only a low level voltage is supplied to the OLED 6, resulting in light emission with a decreased luminance.

In addition, in the conventional image display apparatus, three drivers are separately arranged, i.e., the gate driver and the drain driver 4 that are related with the control lines (the gate line GL and the drain line DL), and the common driver 5 which is related with the power source line (the common line CL). Thus, requirement of space saving is hardly satisfied.

SUMMARY OF THE INVENTION

A driver for driving a display panel having a light emitting element according to one aspect of the present invention includes a plurality of control pads, each of which is electrically connected to a control line of the display panel; and a plurality of power source pads, each of which is electrically connected to a power source line of the display panel and is larger in area than the control pad. The control pads and the power source pads are arranged in line and an order of arrangement of the control pads and the power source pads is symmetrical with respect to a direction of pad arrangement.

A driver for driving a display panel having a light emitting element according to another aspect of the present invention includes a plurality of control pads, each of which is electrically connected to a control line of the display panel; a plurality of spare control pads, each of which has a same shape as the control pad; and a plurality of power source pads, each of which is electrically connected to a power source line of the display panel and is larger in area than the control pad. The control pads, the spare control pads, and the power source pads are arranged in line, and when the control pads and the spare pads are collectively regarded as control pads, an order of arrangement of the control pads and the power source pads is symmetrical with respect to a direction of pad arrangement.

An image display apparatus according to still another aspect of the present invention includes a display panel which has a plurality of pixel circuits arranged in a matrix, each of the pixel circuits including a light emitting element that emits light according to electric current injection; a power source line connected to respective pixel circuits; a plurality of control lines connected to respective pixel circuits; and a pair of drivers respectively provided on two opposite sides of the display panel. Both sides of the power source line are connected to the pair of drivers, respectively, and the control lines include a first control line and a second control line, the first control line being connected to one of the pair of drivers, the second control line being connected to the other of the pair of drivers.

According to the driver for driving a display panel of the present invention, the control pads and the power source pads are arranged together in line, and the order of arrangement of the control pads and the power source pads is symmetrical with respect to the direction of pad arrangement. Hence, when the drivers for display that constitute a driver pair are arranged on the sides of the display panel, both ends of each power source line of the display panel can be connected to the power source pads of the drivers, respectively. Each driver is connected to different control lines. Thus, the voltage drop in the power source lines of the display panel can be reduced, the generation of uneven luminance can be prevented. Further, simplification of the wiring structure of the display panel is achievable, and space saving can be realized.

Still further, according to the driver for a display panel of the present invention, the control pads, the spare control pads, and the power source pads are arranged together in line, and if the control pads and the spare control pads are collectively labeled as the control pads, the order of arrangement of the control pads and the power source pads is symmetrical with respect to the direction of pad arrangement. Hence, when the drivers for display that constitute a driver pair are arranged respectively on the sides of the display panel, both ends of each power source line of the display panel can be connected to the power source pads of the drivers, respectively. Each driver is connected to different control lines. Thus, the voltage drop in the power source lines of the display panel can be reduced, the generation of uneven luminance can be prevented. Further, simplification of the wiring structure of the display panel is achievable, and space saving can be realized.

Still further, according to the image display apparatus of the present invention, the drivers that constitute a driver pair are respectively connected to both ends of each power source line of the display panel, whereas each driver unit is connected to different control lines. Thus, the voltage drop in the power source line can be reduced. Further, the generation of uneven luminance can be prevented, simplification of the wiring structure of the display panel is achievable, and the space saving can be realized.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a driver for a display panel and an image display apparatus according to the present invention will now be described in detail with reference to the accompanying drawings. It should be noted that the present invention is not limited to the embodiments described below.

Figure 1:
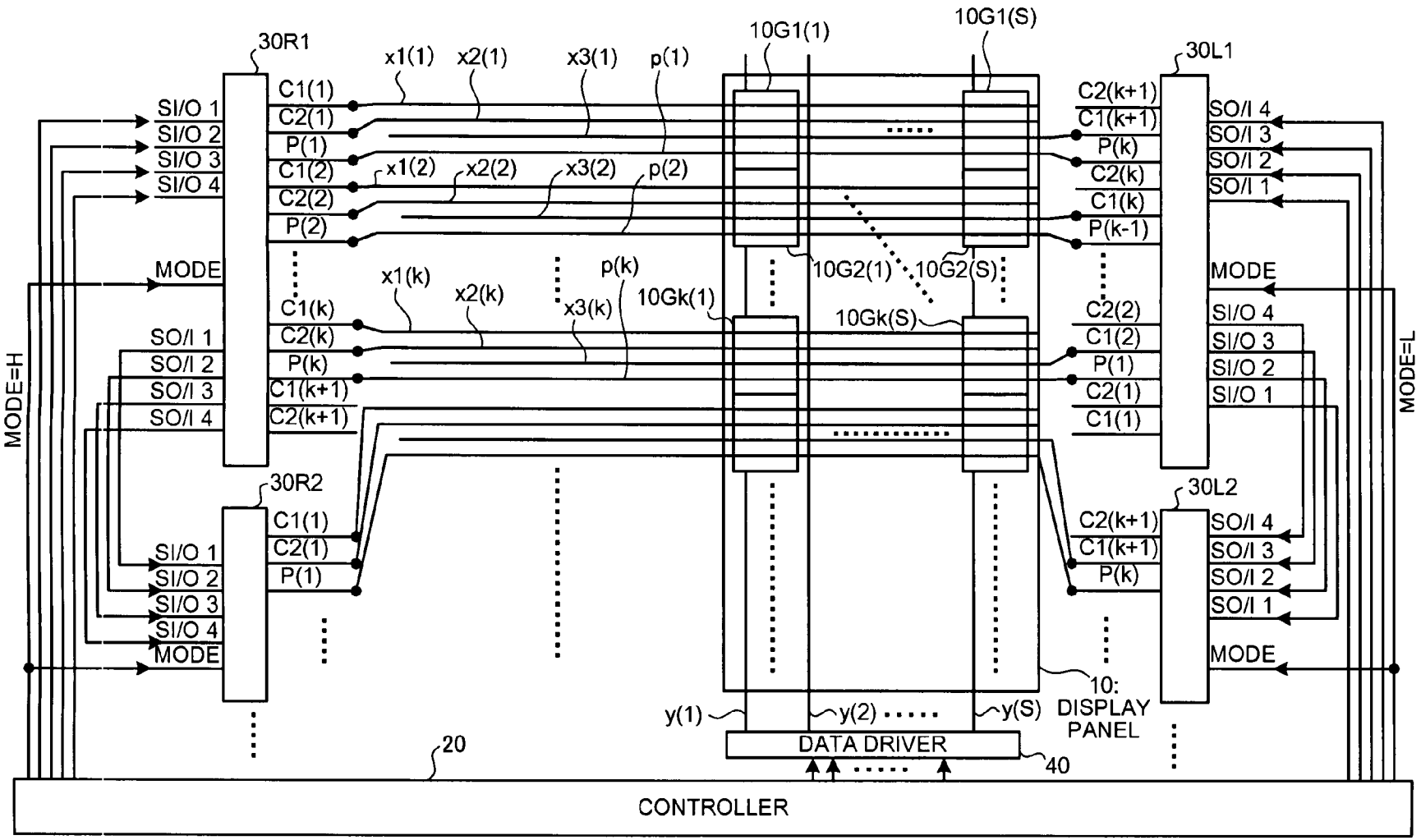
FIG. 1 is a block diagram of a structure of an image display apparatus according to a first embodiment of the present invention.

FIG. 1 is a block diagram of a structure of an image display apparatus according to a first embodiment of the present invention. The image display apparatus shown in FIG. 1 includes a display panel 10, a controller 20, a gate drivers 30R1, a gate driver 30R2, . . . , a gate drier 30L1, a gate driver 30L2, . . . , and a data driver 40.

The display panel 10 includes a pixel circuit 10G1(1), . . . , a pixel circuit 10G1(*s*), a pixel circuit 10G2(1), . . . , a pixel circuit 10G2(*s*), a pixel circuit 10Gk(1), . . . , a pixel circuit 10Gk(s), . . . .

In the display panel 10, plural sets of four lines are arranged, one set for each row (provided in the horizontal direction in the drawing). For example, a first control line x1(1), a second control line x2(1), a third control line x3(1), and a power source line p(1) shown in FIG. 1 constitute one set.

Specifically, for a first row which corresponds to the pixel circuits 10G1(1) to 10G1(*s*) in the display panel, four lines, i.e., the first control line x1(1), the second control line x2(1), the third control line x3(1), and the power source line p(1) are provided.

For a second row which corresponds to the pixel circuits 10G2(1) to 10G2(*s*) in the display panel 10, four lines, i.e., a first control line x1(2), a second control line x2(2), a third control line x3(2), and a power source line p(2) are provided.

Similarly, for a $k^{th}$ row which corresponds to the pixel circuits 10Gk(1) to 10Gk(s) in the display panel 10, four lines, i.e., a first control line x1(*k*), a second control line x2(*k*), a third control line x3(*k*), and a power source line p(k) are provided.

Further, in the display panel 10, s data lines y(1) to y(s) are arranged one for each column (the vertical direction in the drawing).

Figure 2:
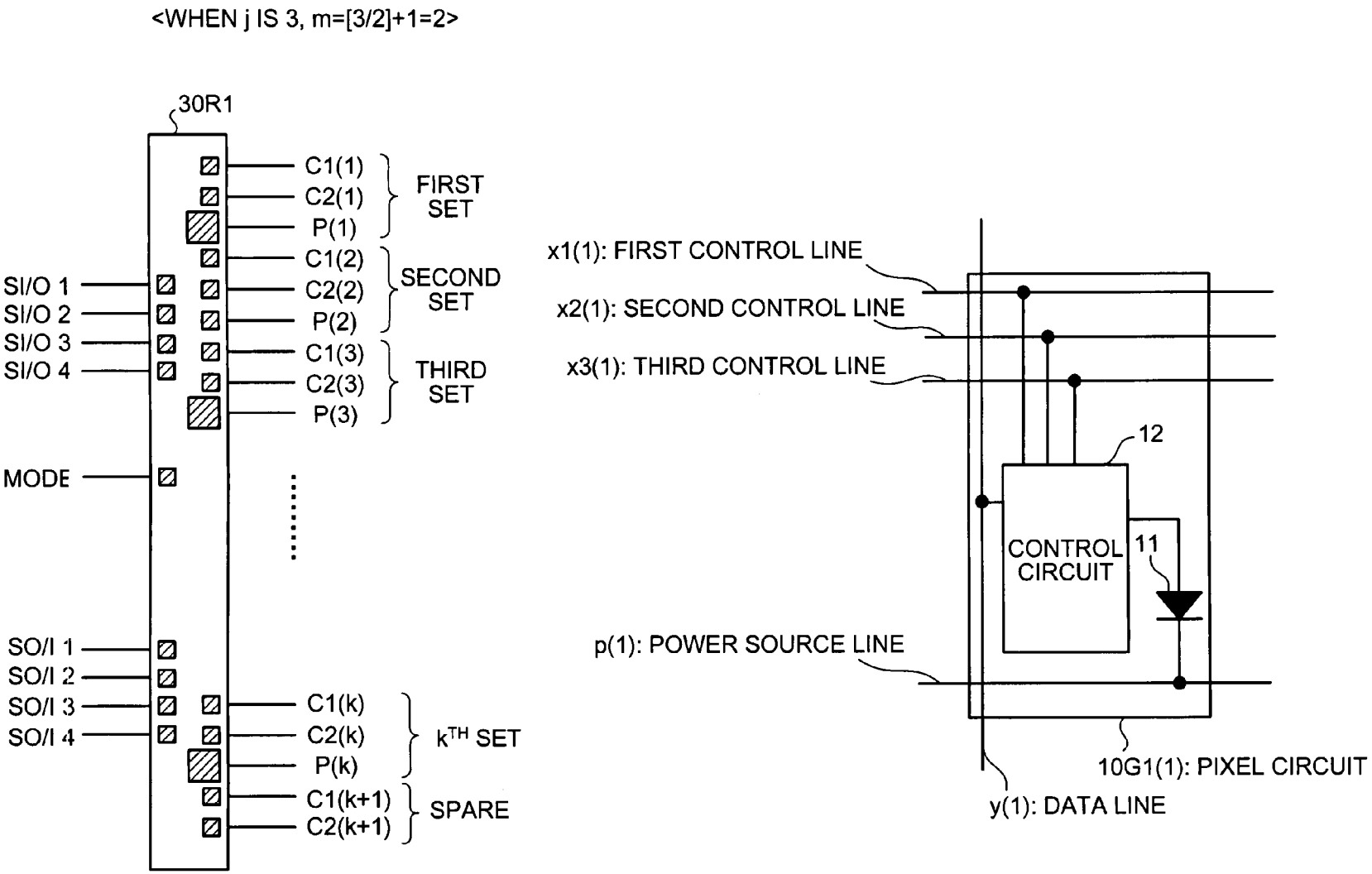
FIG. 2 is a diagram of a structure of a gate driver and a pixel circuit shown in FIG. 1.

As shown in FIG. 2, the pixel circuit 10G1(1) includes an OLED 11 and a control circuit 12. The OLED 11 is a light emitting device that emits light when a voltage equal to or higher than a threshold is applied between an anode and a cathode. The cathode of the OLED 11 is connected to a power source line p(1). Depending on the circuit design consideration, the connections to the anode and to the cathode of the OLED 11 may be reversed.

The control circuit 12 includes elements such as a driving transistor, a selecting transistor, and a capacitor, similarly to the driving transistor 7, the selecting transistor 8, and the capacitor Cp (see FIG. 8) mentioned above, and serves to control the light emission by the OLED 11.

The control circuit 12 is connected to the first control line x1(1), the second control line x2(1), the third control line x3(1), and the data line y(1). Here, the first control line XL(1), the second control line x2(1), and the third control line x3(1) correspond to the gate line GL, the drain line DL, or the like (see FIG. 8) mentioned above, a scan line transmitting a selection signal for row selection, a control line transmitting a reset signal for reset of electric charges accumulated in a capacitance or a light emitting element, or the like.

Figure 8:
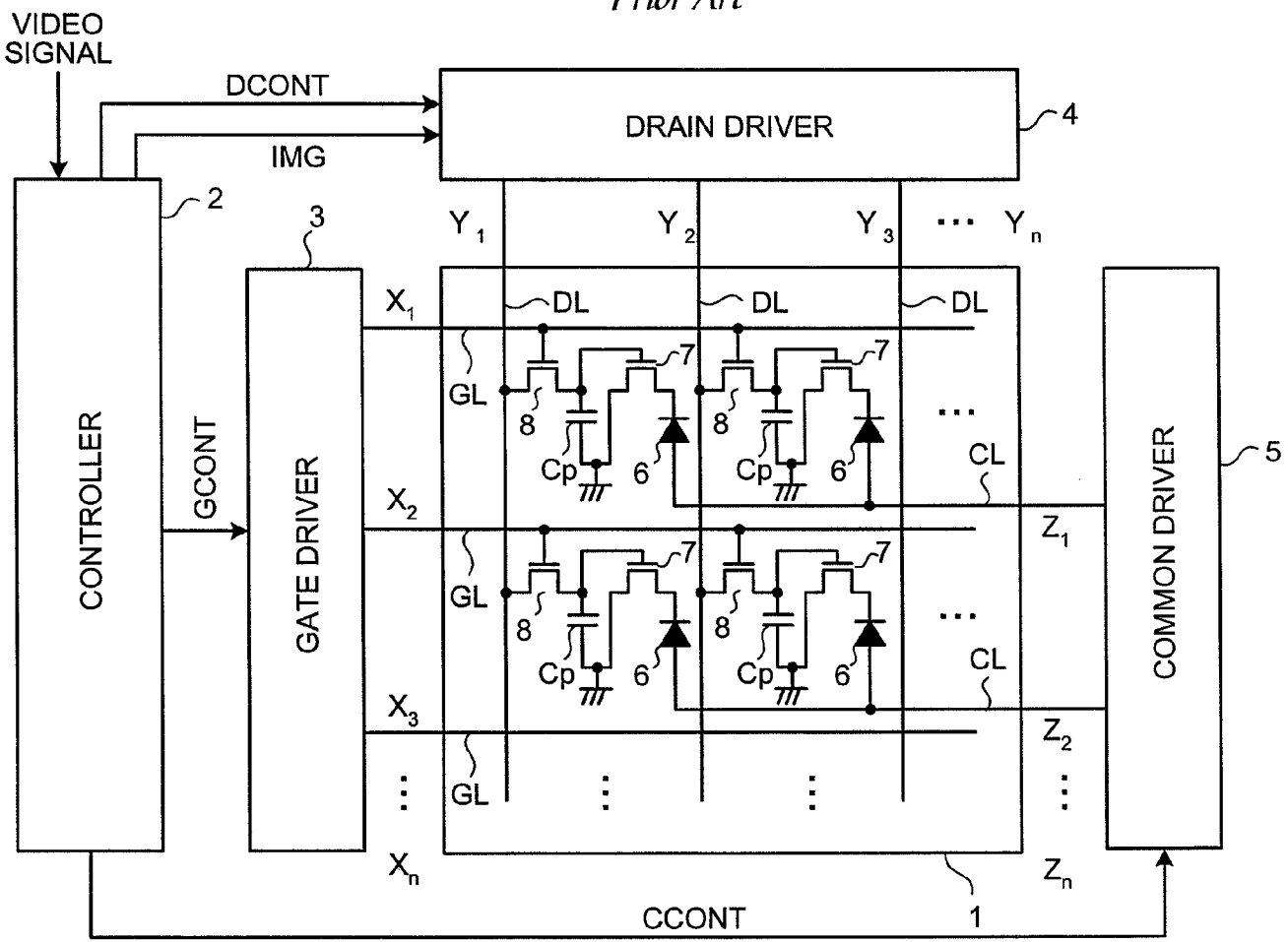
FIG.8 Prior Art
FIG. 8 is a diagram of a structure of a conventional image display apparatus.

Similarly, other lines shown in FIG. 1 such as the first control line x1(2), the second control line x2(2), the third control line x3(2), and the data line y(2) correspond to lines such as the gate line GL and the drain line DL (see FIG. 8).

The pixel circuits in the display panel 10 of FIG. 1 other than the pixel circuit 10G1(1) described above have the same structure as the pixel circuit 10G1(1).

The controller 20 is connected to the gate driver 30R1, the gate driver 30R2, . . . , the gate driver 30L1, the gate driver 30L2, . . . , and the data driver 40, and serves to control an image display apparatus on the display panel 10.

Further, on respective sides of the display panel 10, the gate driver 30R1, the gate driver 30R2, . . . , the gate driver 30L1, the gate driver 30L2, . . . , of same circuit design are provided. More specifically, the gate drivers 30R1, 30R2, . . . , are provided on the left side of the display panel 10, whereas the gate drivers 30L1, 30L2, . . . are provided on the right side of the display panel 10.

In an actual display, the gate drivers 30R1, 30R2, . . . are provided in the vicinity of the display panel 10 similarly to the gate drivers 30L1, 30L2, . . . .

The gate drivers 30R1, 30R2, . . . , are in charge of half (or approximately half of) the control lines in the display panel 10 while the gate drivers 30L1, 30L2, . . . are in charge of the remaining half (or approximately half) when there are even number of control lines (or when there are odd number of control lines).

Figure 3:
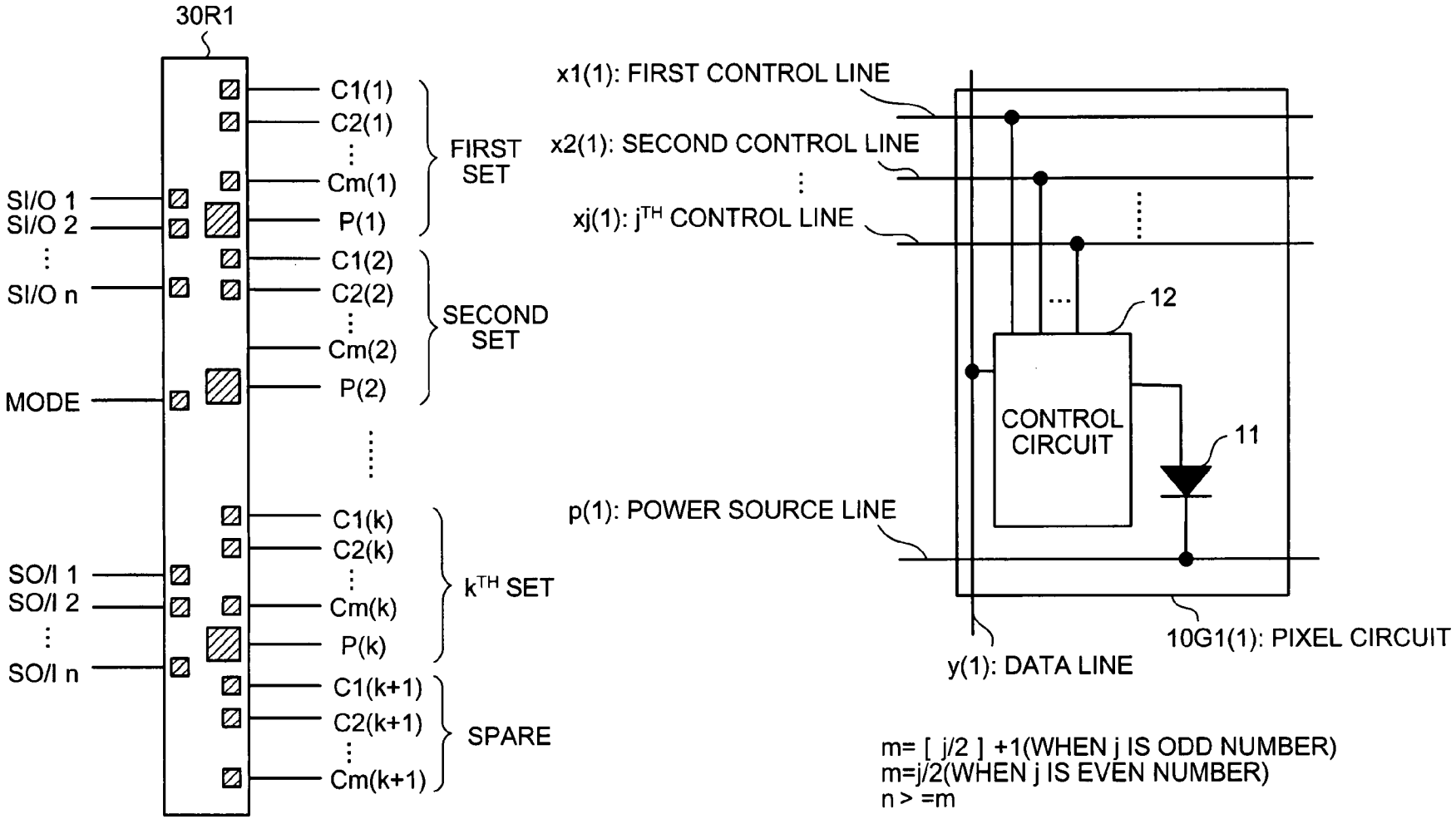
FIG. 3 is a diagram of a generalized structure of the gate driver and the pixel circuit shown in FIG. 2.

Here, with reference to FIG. 3, a generalized structure of the gate drivers 30R1, 30R2, . . . and 30L1, 30L2, . . . will be described. In FIG. 3, the gate driver 30R1 is shown as an example.

The gate driver 30R1 is provided with a plurality of pads consisting of $1^{st}$ to $k^{th}$ sets of pads and spare pads (shown by hatched rectangles in FIG. 3). The first set of pads includes a control pad C1(1), a control pad C2(1), . . . , a control pad Cm(1), and a power source pad P(1). The second set of pads includes a control pad C1(2), a control pad C2(2), . . . , a control pad Cm(2), and a power source pad P(2). Similarly, the $k^{th}$ set of pads includes a control pad C1(*k*), a control pad C2(*k*), . . . , a control pad Cm(k), and a power source pad P(k).

The spare pads are a spare pad C1(*k*+1), a spare pad C2(*k*+1), . . . , a spare pad Cm(k+1). These spare pads C1(*k*+1), C2(*k*+1), . . . , Cm(k+1) can be regarded as pads of same type with same area as the control pad C1(1) or the like.

The gate driver 30R1 is further provided with input pads S1/O1 to S1/On (here, n≥m), an input pad MODE, and output pads SO/I1 to SO/In. Among these pads, the power source pads P(1), P(2), P(k), . . . , P(k+1) are larger than other pads (control pad C1(1) to C1(*k*+1) in area since the power source pads P(1), P(2), P(k), . . . , P(k+1) have to receive a large electric current.

Thus in the gate driver 30R1, pads with a large area and a small area are arranged together in line. The order of arrangement (or the arranged positions) of the power source pad P(1) or the like and the control pad C1(1) or the like are symmetrical with respect to the arrangement direction of the pads. Further, the number of the control pads C1(1) or the like is larger than the number of the power source pad P(1) or the like. Here in FIG. 3, the pixel circuit 10G1(1) has j control lines which are shown as control lines x1(1) to xj(1).

If j is an odd number, "m" in the reference characters for the control pads Cm(1) to Cm(k), and Cm(k+1) can be represented as [j/2]+1. Here, [ ] is the Gaussian code. On the other hand, if j is an even number, "m" in the reference characters for the control pads Cm(1) to Cm(k), and Cm(k+1) can be represented as (j/2).

In the gate driver 30R1 shown in FIG. 1, j is three, m is two, and n is four, hence the gate driver of FIG. 2 is applicable for the device of FIG. 1. Further, the driver 30L1 has a similar circuit design as the gate driver 30R1, and a set of pads in the gate driver 30L1 corresponding to the first set in the gate driver 30R1 includes the control pads C2(*k*+1), C1(*k*+1) and the power source pad P(k).

Further, a set of pads in the gate driver 30L1 corresponding to the second set in the gate driver 30R1 includes the control pads C2(*k*), C1(*k*), and the power source pad P(k−1). Similarly, a set of pads in the gate driver 30L1 corresponding to the $k^{th}$ set in the gate driver 30R1 includes the control pad C2(2), C1(2), and the power source pad P(1). Further, spare pads in the gate driver 30L1 are control pads C2(1) and C1(1).

Next, the power source line p(1) corresponding to the first set will be described. The power source line p(1) has a left end connected to the power source pad P(1) of the gate driver 30R1, and a right end connected to the power source pad P(k) of the gate driver 30L1 for the reduction of power drop since voltage level of a signal transmitted via the power source line p(1) is high.

On the other hand, the first control line x1(1) and the second control line x2(1) corresponding to the first set are connected to the control pads C1(1) and C2(1) of the gate driver 30R1 at the left ends, respectively. Right ends of the first control line x1(1) and the second control line x2(1) are not connected to any control pads of the gate driver 30L1, since voltage level of a signal transmitted via these lines are low and the influence of voltage drop is ignorable.

The third control line x3(1) corresponding to the first set has a right end connected to the control pad C1(*k*+1) of the gate driver 30L1. A left end of the third control line x3(1) is not connected to any control pads of the gate driver 30R1 since voltage level of a signal to be transmitted is low and influence of voltage drop is ignorable.

Thus in the first set, the power source line p(1) is controlled by both of the gate drivers 30R1 and 30L1 for the reduction of voltage drop. On the other hand, the first control line x1(1) and the second control line x2(1) are controlled by the gate driver 30R1. The third control line x3(1) is controlled by the gate driver 30L1. Such relation applies similarly to other sets.

The gate drivers 30R1, 30R2, . . . , are connected in series. Similarly, the gate drivers 30L1, 30L2, . . . , are connected in series.

The data driver 40 outputs selection signals to the data lines y(1) to y(s), respectively, according to a gate control signal supplied from the controller 20. The selection signal serves to select one column on the display panel 10 and only one of the selection signals is rendered active at one time.

Figure 4:
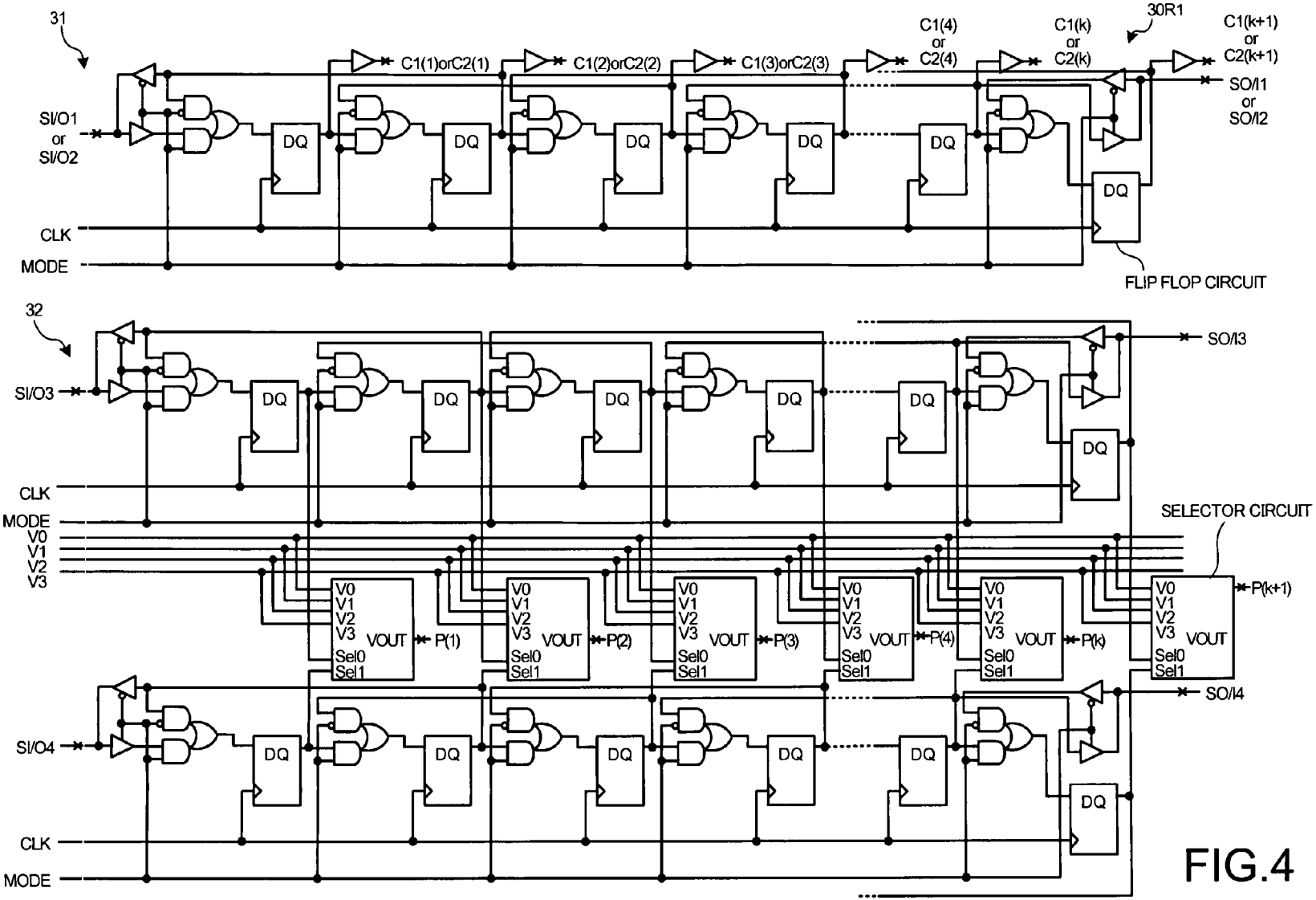
FIG. 4 is a diagram of a structure of the gate driver shown in FIG. 1.

FIG. 4 is a diagram of a structure of the gate driver 30R1 shown in FIG. 1. In FIG. 4, elements corresponding to the elements in FIG. 1 are denoted by the same reference characters as in FIG. 1. The gate driver 30R1 includes a shift register 31, and a shift register 32.

Figure 5:
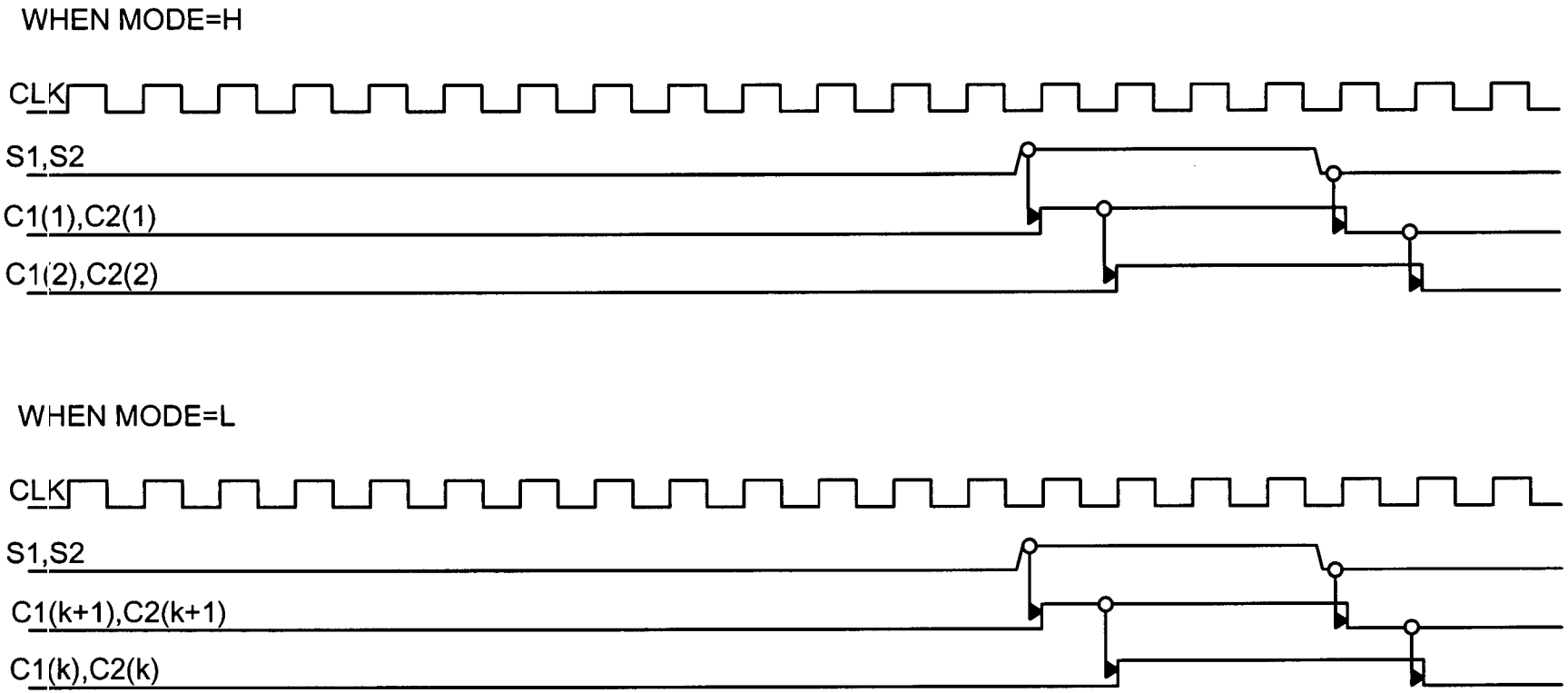
FIG. 5 is a timing chart of an operation of the gate driver shown in FIG. 1.

The shift register 31 includes a plurality of flip flop circuits and a plurality of logic circuits. As shown in FIG. 5, the shift register 31 shifts signals retained in respective flip flop circuits at a timing of rising of the clock signal CLK based on a signal supplied from the controller 20 and outputs the resulting signal to control pads C1(1), C1(2), . . . , (control pad C2(1), C2(2), . . . ).

On the other hand, the shift register 32 shown in FIG. 4 includes a plurality of flip flop circuits, a plurality of logic circuits, and a plurality of selector circuits. As shown in FIG. 5, the shift register 32 shifts signals retained in respective flip flop circuits at a timing of a rising of the clock signal CLK based on the signal supplied from the controller 20 and outputs the resulting signals to the power source pads P(1), P(2), . . . .

Here, the power source pad P(k) and the power source pad P(k−1) shown in FIG. 1 of the gate driver 30L1 also output the signal at the same timing with the gate driver 30R1. These signals are supplied to the corresponding OLED 11(see FIG. 2) and function together with the control signal (ON/OFF) as power source voltage to cause the OLED 11 to emit light.

Hence, according to the first embodiment, since the gate driver 30L1 and the gate driver 30R1 on respective sides of the display panel supply signals to the power source line p(1), the transmission path length of the signal is significantly shorter than that in the conventional arrangement where the gate driver is located only on one side, whereby the voltage drop can be reduced.

When the signals are supplied from the gate drivers 30R1, 30L1, or the like, and the data driver 40 to the display panel 10 under the control of the controller 20, the light emission by the OLED 11 is controlled and an image is displayed on the display panel 10.

As described above, in the first embodiment, the gate driver 30R1 and the gate driver 30L1 are provided on the sides of the display panel 10 as a pair, and the gate drivers 30R1 and 30L1 are both connected to the power source lines p(1), p(2), . . . , and connected to different first control lines among the first control lines x1(1), x1(2), . . . , and drive the pixel circuits 10G1(1) to 10Gk(s) according to the signals. Thus, the voltage drop on the power source lines p(1), p(2), . . . is reduced to allow prevention of generation of uneven luminance and space saving can be realized.

Further in the first embodiment, since the driver unit (the gate driver 30R1, the gate driver 30L1, or the like) has pads of different size (such as the control pad C1(1), the power source pad P(1)), without refinement of the pad arrangement, the wiring structure of the power source lines and the control lines in the display panel 10 becomes complicated when the driver units are arranged on respective sides of the display panel 10.

Hence in the first embodiment, with the refinement of the pad arrangement in the driver unit (such as the arrangement of the spare control pads, and the symmetrical arrangement), the complication of the wiring structure on the display panel 10 can be suppressed well even when the driver units are arranged on respective sides of the display panel 10. Here, though the symmetrical arrangement of the order of the pads may be good enough (including an arrangement where the pads are in the same order in each set, but the interval between pads is not same in each set), the further simplification of the wiring structure is achievable if the pads are arranged symmetrically with respect to the positions.

In the description of the first embodiment, an exemplary structure with one power source line p(1) per one set as shown in FIG. 3 is described. The number of the power source lines per one set may be two (or more than two). In the following such an exemplary structure will be described as a second embodiment.

Figure 6:
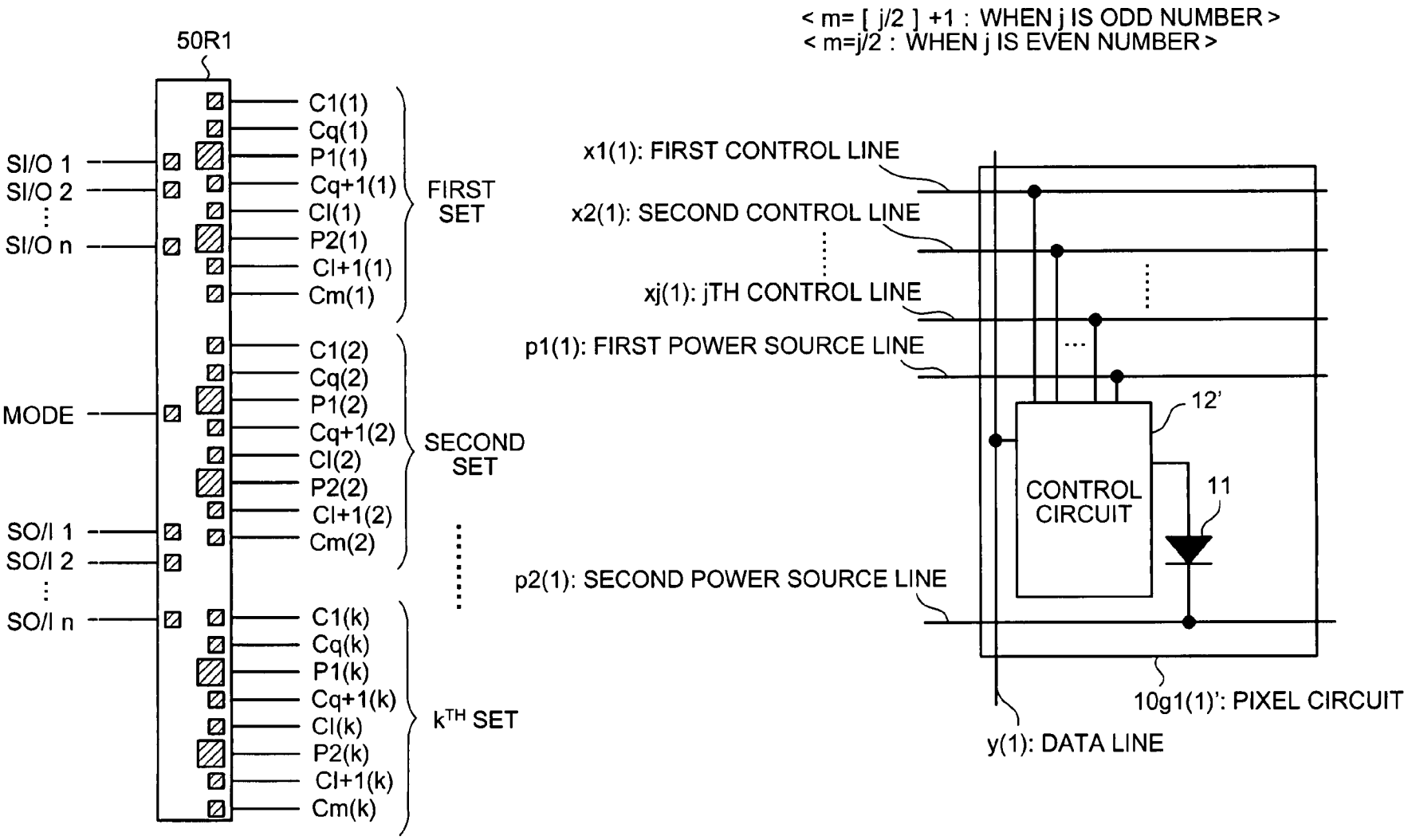
FIG. 6 is a diagram of a structure of elements such as a gate driver, and a pixel circuit applied in a second embodiment of the present invention.

FIG. 6 is a diagram of a structure of the gate driver 50R1, the pixel circuit 10G1(1), or the like applied to the second embodiment of the present invention. In FIG. 6, elements corresponding to the elements shown in FIG. 3 are denoted by the same reference characters.

In the pixel circuits 10G1(1)' shown in FIG. 6, j first control lines x1(1), . . . , xj(1), and a first power source line p1(1) and a second power source line p2(1) are arranged in a row direction.

The gate driver 50R1 is provided with a plurality of pads, i.e., first to $k^{th}$ sets of pads. The first set includes a control pad C1(1), a control pad Cq(1), a control pad Cq+1(1), a control pad C1(1), a control pad C1+1(1), a control pad Cm(1), a power source pad P1(1), and a power source pad P2(1).

The second set includes a control pad C1(2), a control pad Cq(2), a control pad Cq+1(2), a control pad C1(2), a control pad C1+1(2), a control pad Cm(2), a power source pad P1(2), and a power source pad P2(2).

Similarly, the $k^{th}$ set includes a control pad C1(*k*), a control pad Cq(k), a control pad Cq+1(k), a control pad C1(*k*), a control pad C1+1(k), a control pad Cm(k), a power source pad P1(*k*), and a power source pad P2(*k*).

Further, the pixel circuit 10G1(1)' includes j control lines which are shown as a first control line x1(1) to a $j^{th}$ control line xj(1). Still further, the pixel circuit 10G1(1)' includes a first power source line p1(1) and a second power source line p2(1) as the power source lines.

Similarly to the first embodiment, when j is an odd number, 'm' in the reference characters for the control pads Cm(1), Cm(2), . . . , Cm(k) can be represented as [j/2]+1. On the other hand, if j is an even number, "m" in the reference character for the control pads Cm(1), Cm(2), . . . , Cm(k) can be represented as (j/2).

In a second embodiment, a gate driver (not shown) with a similar circuit design as the gate driver 50R1 of FIG. 6 is provided at a position corresponding to the position of the gate driver 30L1 in FIG. 1.

Next, the first control line x1(1), the second control line x2(1), . . . , the $j^{th}$ control line xj (1), the first power source line p1(1), and the second power source line p2(1) corresponding to the first set will be described. The first power source line p1(1) and the second power source line p2(1) have a left end connected to the power source pad P1(1) and the power source pad P2(1) of the gate driver 50R1, and a right end connected to the two power source pads (not shown) of the gate driver (not shown) with the same circuit design as the gate driver 50R1, for the reduction of voltage drop since voltage level of a signal transmitted via the power source lines p(1) and p2(1) is high.

On the other hand, the first control line x1(1), the second control line x2(1), . . . , the $j^{th}$ control line xj (1) are connected to different pads among the control pads of the first set in the left side gate driver 50R1 and the control pads of the right side gate driver (not shown).

Thus, the first power source line p1(1) and the second power source line p2(1) in the first set are controlled by both of the left side gate driver 50R1 and the right side gate driver (not shown) for the reduction of voltage drop. Similar relation holds for other sets.

Figure 7:
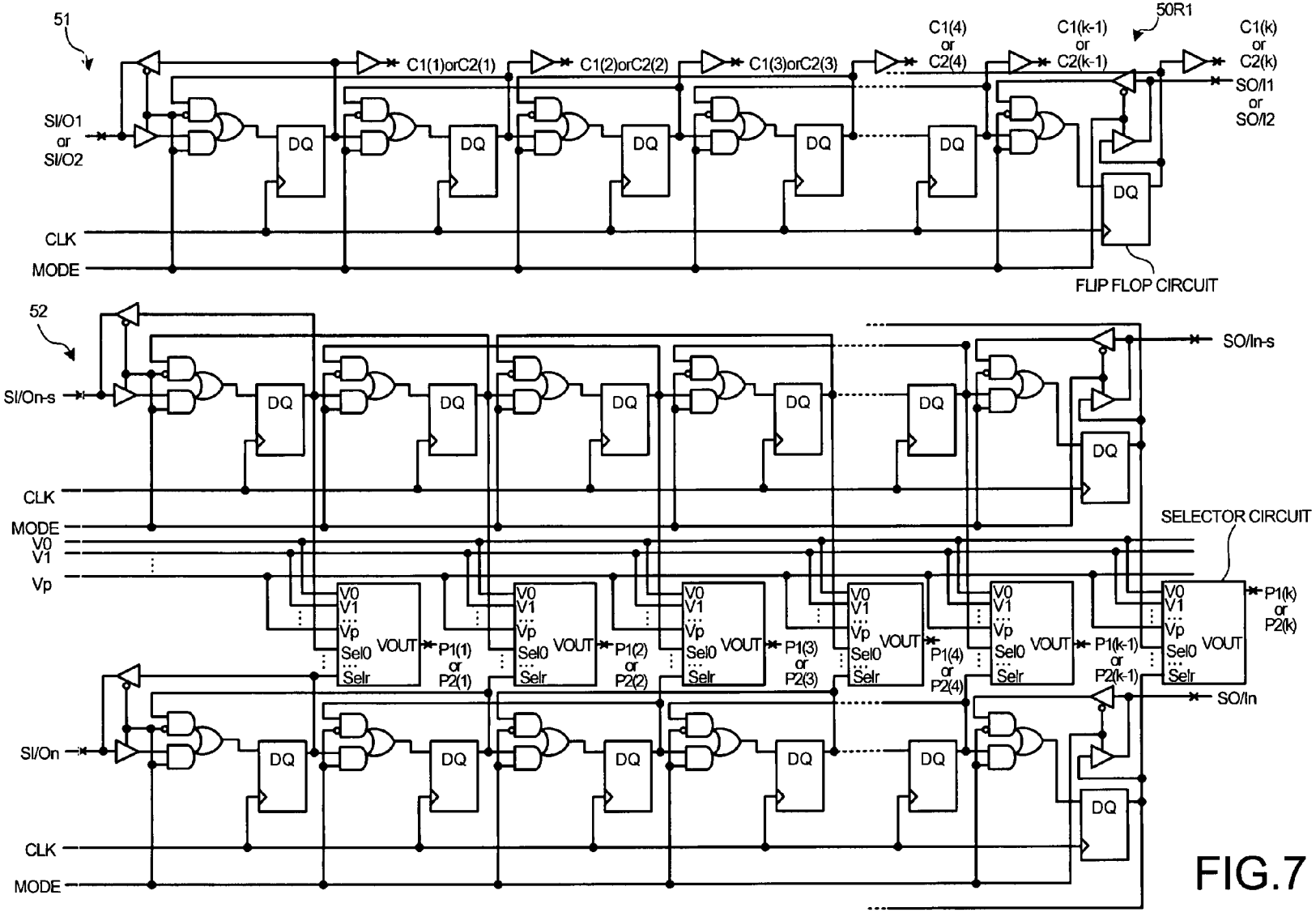
FIG. 7 is a diagram of a structure of the gate driver shown in FIG. 6.

FIG. 7 is a diagram of a structure of the gate driver 50R1 shown in FIG. 6. In FIG. 7, the elements corresponding to those shown in FIG. 6 are denoted by the same reference characters. The gate driver 50R1 includes a shift register 51 and a shift register 52.

The shift register 51 includes a plurality of flip flop circuits and a plurality of logic circuits. The shift register 51 shifts signals retained by flip flop circuits at a timing of a rising of a clock signal CLK according to a signal supplied from a controller (not shown) to output the resulting signals to the control pads C1(1), C1(2), . . . (control pads C2(1), C2(2), . . . ).

On the other hand, the shift register 52 also includes a plurality of flip flop circuits, a plurality of logic circuits, and a plurality of selector circuits. The shift register 52 shifts signals retained by flip flop circuits at a timing of a rising of the clock signal CLK according to a signal supplied from the controller (not shown) to output the resulting signals to the power source pads P1(1)(the power source pad P2(1)), and the power source pad P1(2)(the power source pad P2(2)).

Here, each of the power source pads (not shown) of the right side gate driver (not shown) corresponding to the left side gate driver 50R1 also supplies a signal at the same timing as in the gate driver 50R1. These signals are supplied to respective OLED 11 (see FIG. 6) and function together with the control signal (ON/OFF) as power source voltage to cause light emission by the OLED 11.

Hence, in the second embodiment similarly to the first embodiment, since signals are supplied from both the gate driver 50R1 and the gate driver (not shown) on the other side to the first power source line p1(1) and the second power source line p2(1), the transmission path length of the signal is significantly reduced compared with that in the structure where the gate driver is provided only to one side, whereby the voltage drop is decreased.

As can be seen from the foregoing, the second embodiment exerts the same effect as the first embodiment.

As is clear from the above, the driver for the display panel and the image display apparatus for the present invention is useful for the improvement in uneven luminance and for the space saving.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A driver for driving a plurality of pixel circuits each including a light emitting element, the driver comprising:

a plurality of input pads arranged along a first line; and a plurality of pad sets corresponding respectively to the pixel circuits, each pad set including a plurality of control pads and at least one power source pad having a larger area than the control pad, an order of arrangement of the control pads and the power source pad being the same in each pad set, the control pads being connected to a corresponding pixel circuit to supply control signals for controlling a corresponding light emitting element to the corresponding pixel circuit, the power source pad being connected to a corresponding pixel circuit for supplying power to the corresponding pixel circuit to drive a corresponding light emitting element, the pad sets being arranged so that the respective control pads and the respective power source pads are symmetrically arranged along a second line adjacent to and parallel to the first line.

2. The driver according to claim 1, wherein all the pads are arranged in a symmetrical design with respect to a direction along the second line of pads set as a whole.

3. The driver according to claim 1, wherein a number of the control pads is equal to or larger than a number of the power source pads.

4. A driver for driving a plurality of pixel circuits each including a light emitting element, the driver comprising:

a plurality of input pads arranged along a first line;

a plurality of pad sets corresponding respectively to the pixel circuits, each pad set including a plurality of control pads and at least one power source pad having a larger area than the control pad, an order of arrangement of the control pads and the power source pad being the same in each pad set, the control pads being connected to a corresponding pixel circuit to supply control signals for controlling a corresponding light emitting element to the corresponding pixel circuit, the power source pad being connected to a corresponding pixel circuit for supplying power to the corresponding pixel circuit to drive a corresponding light emitting element, the pad sets being arranged so that the respective control pads and the respective power source pads are arranged symmetrically along a second line adjacent to and parallel to the first line; and a plurality of spare control pads each having a same shape as the control pad, the spare control pads being arranged along the second line after the end of the pad sets.

5. The driver according to claim 4, wherein all the pads included in the and the spare control pads are arranged in a symmetrical design with respect to a direction along the second line of pads as a whole.

6. The driver according to claim 4, wherein a number of the control pads is larger than a number of the power source pads.

7. The driver according to claim 4, wherein the number of the spare control pads is the same as the number of the control pads in each pad set.

8. The driver according to claim 4, wherein the control pad and the spare control pad have a flip flop circuit each corresponds to a pad and connected in series.

9. An image display apparatus comprising:

a display panel which includes a plurality of pixel circuits arranged in a matrix, each of the pixel circuits including a light emitting element; and first and second drivers for driving the pixel circuits, the drivers being arranged respectively on two opposite sides of the display panel, wherein each of the drivers includes a plurality of pad sets corresponding respectively to the pixel circuits, each pad set including a plurality of control pads and at least one power source pad, an order of arrangement of the control pads and the power source pad being the same in each pad set, the control pads being connected to a corresponding pixel circuit to supply control signals for controlling a corresponding light emitting element to the corresponding pixel circuit, the power source pad being connected to a corresponding pixel circuit for supplying power to the corresponding pixel circuit to drive a corresponding light emitting element, the pad sets being arranged so that the respective control pads and the respective power source pads are arranged along a line, wherein the pad sets of the first driver are associated with those of the second driver, respectively, so that a pair of pad sets is provided to control a same pixel circuit, each pixel circuit being connected to a pair of power source pads of a corresponding pair of pad sets, each pixel circuit being connected to one of a pair of control pads in respective pairs of control pads of a corresponding pair of pad sets so that at least one control pad of the first driver and at least one control pad of the second driver are connected to the corresponding pixel circuit.

10. The image display apparatus according to claim 9, wherein all the pads are arranged in a symmetrical design with respect to a direction along the line as a whole.

11. The image display apparatus according to claim 9, wherein each of the power source pads has a larger area than the control pad.

12. The image display apparatus according to claim 9, wherein each of the drivers further includes:

a plurality of spare control pads each having a same shape as the control pad, the spare control pads being arranged along the line after the end of the pad sets.

13. The image display apparatus according to claim 9, wherein the control signals includes one of a selection signal and a reset signal.

14. The image display apparatus according to claim 9, wherein the drivers have a substantially same circuit design.

15. The image display apparatus according to claim 9, wherein the light emitting element is an organic light emitting diode.

* * * * *

UNITED STATES PATENT AND TRADEMARK OFFICE

CERTIFICATE OF CORRECTION

PATENT NO. : 8,587,566 B2
APPLICATION NO. : 11/159317
DATED : November 19, 2013
INVENTOR(S) : Shinya Ono et al.

It is certified that error appears in the above-identified patent and that said Letters Patent is hereby corrected as shown below:

ON THE TITLE PAGE:

At item (73), correct the identification of the Assignees to read as follows:

--(73) Assignees: Kyocera Corporation, Kyoto-Shi (JP); Chimei Innolux Corporation, Miao-Li County (TW)--.

Signed and Sealed this
Eleventh Day of February, 2014

Michelle K. Lee

Michelle K. Lee
*Deputy Director of the United States Patent and Trademark Office*